US007849692B2

(12) United States Patent
Baldwin et al.

(10) Patent No.: US 7,849,692 B2
(45) Date of Patent: Dec. 14, 2010

(54) SEGMENTED HEAT EXCHANGER

(75) Inventors: Darryl Dean Baldwin, Lafayette, IN (US); Martin Leo Willi, Dunlap, IL (US); Scott Byron Fiveland, Metamara, IL (US); Kristine Ann Timmons, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 1171 days.

(21) Appl. No.: 11/495,657

(22) Filed: Jul. 31, 2006

(65) Prior Publication Data

US 2008/0022684 A1 Jan. 31, 2008

(51) Int. Cl.
*F01K 7/34* (2006.01)

(52) U.S. Cl. ..... 60/653

(58) Field of Classification Search ..... 60/39.182, 60/653

See application file for complete search history.

(56) References Cited

U.S. PATENT DOCUMENTS 3,001,513 A * 9/1961 Wolf et al. ..... 122/7 B
6,109,020 A 8/2000 Liebig
6,571,548 B1 6/2003 Bronicki et al.
6,668,537 B1 12/2003 Hays
6,877,319 B2 4/2005 Linder et al.
6,877,323 B2 4/2005 Dewis
6,895,740 B2 5/2005 Erickson
6,920,760 B2 7/2005 Schöttler et al.
6,938,423 B2 9/2005 Strand
6,959,555 B2 11/2005 Bell
2005/0235625 A1 10/2005 Gericke et al.
2007/0227145 A1 * 10/2007 Conturie et al. ..... 60/653

* cited by examiner

*Primary Examiner*—Hoang M Nguyen
(74) *Attorney, Agent, or Firm*—Finnegan, Henderson, Farabow, Garrett & Dunner LLP

(57) ABSTRACT

A segmented heat exchanger system for transferring heat energy from an exhaust fluid to a working fluid. The heat exchanger system may include a first heat exchanger for receiving incoming working fluid and the exhaust fluid. The working fluid and exhaust fluid may travel through at least a portion of the first heat exchanger in a parallel flow configuration. In addition, the heat exchanger system may include a second heat exchanger for receiving working fluid from the first heat exchanger and exhaust fluid from a third heat exchanger. The working fluid and exhaust fluid may travel through at least a portion of the second heat exchanger in a counter flow configuration. Furthermore, the heat exchanger system may include a third heat exchanger for receiving working fluid from the second heat exchanger and exhaust fluid from the first heat exchanger. The working fluid and exhaust fluid may travel through at least a portion of the third heat exchanger in a parallel flow configuration.

20 Claims, 1 Drawing Sheet

SEGMENTED HEAT EXCHANGER

U.S. GOVERNMENT RIGHTS

This invention was made with government support under the terms of DE-FC26-01CH11079 awarded by the Department of Energy. The government may have certain rights in this invention.

TECHNICAL FIELD

The present disclosure relates generally to recovery of residual heat energy from hot exhaust streams and, more particularly, to improvements in heat recovery methods.

BACKGROUND

Throughout the world, many systems, such as, for example, power generation plants, which depend upon an inflow of a heated or super-heated working fluid (e.g., steam or a chemical refrigerant) to turn mechanical energy into electrical energy, produce exhaust gases that are usually extremely hot. These gases are often exhausted into the open atmosphere, thereby wasting any residual heat energy contained therein. Since the operation of such systems depends upon the inflow of a heated or super-heated fluid, the overall efficiency of these systems may be improved by a mechanism, such as, for example, a heat exchanger, configured to recapture at least a portion of the residual waste heat energy for use in heating the incoming working fluid.

In those systems that use a chemical as the working fluid, such as, for example, an organic Rankine cycle, the working fluid may be piped through a first tube, while the exhaust gases are piped through a second tube that concentrically surrounds the first tube, in order to efficiently transfer heat energy from the exhaust gases to the working fluid. In such an arrangement, since the exhaust gases are usually extremely hot, the surface temperatures of the first and second tubes can frequently exceed the fluid degradation temperature of the chemical working fluid, thereby causing any molecules of the chemical working fluid in direct contact with a surface of the first tube to overheat and breakdown or disintegrate.

Working fluid degradation has been addressed in the art by utilizing an intermediate fluid, such as, for example, water, to aid in the transfer of heat energy from the hot exhaust gases to the chemical working fluid. For instance, the use of such an intermediate fluid is described in U.S. Pat. No. 6,571,548 issued to Bronicki et al. on Jun. 3, 2003. Although such use of an intermediate fluid appears viable, the high expense, complexity, and loss of heat energy involved with a separate intermediate fluid heat transfer mechanism renders it commercially challenged. Providing a mechanism to efficiently utilize a maximum amount of waste heat energy contained in exhaust gases, while minimizing working fluid degradation without having to reduce the overall working fluid temperature or sacrifice efficiency, has therefore been problematic and elusive.

The present disclosure is directed to overcoming one or more of the shortcomings set forth above.

SUMMARY OF THE INVENTION

In one aspect, the present disclosure is directed to a segmented heat exchanger system for transferring heat energy from an exhaust fluid to a working fluid. The heat exchanger system may include a first heat exchanger for receiving incoming working fluid and the exhaust fluid. The working fluid and exhaust fluid may travel through at least a portion of the first heat exchanger in a parallel flow configuration. In addition, the heat exchanger system may include a second heat exchanger for receiving working fluid from the first heat exchanger and exhaust fluid from a third heat exchanger. The working fluid and exhaust fluid may travel through at least a portion of the second heat exchanger in a counter flow configuration. Furthermore, the heat exchanger system may include a third heat exchanger for receiving working fluid from the second heat exchanger and exhaust fluid from the first heat exchanger. The working fluid and exhaust fluid may travel through at least a portion of the third heat exchanger in a parallel flow configuration.

In another aspect, the present disclosure is directed to a method of heating a working fluid with heat energy contained in an exhaust fluid, the method including providing a segmented heat exchanger system having a first heat exchanger configured in a parallel flow arrangement, a second heat exchanger configured in a counter flow arrangement, and a third heat exchanger configured in a parallel flow arrangement. The method also includes channeling the working fluid through the first, second, and third heat exchangers, and channeling the exhaust fluid first through the first heat exchanger, next through the third heat exchanger, and then through the second heat exchanger.

In yet another aspect, the present disclosure is directed to a segmented heat exchanger system for transferring heat energy from an exhaust fluid to a working fluid. The heat exchanger system may include a first heat exchanger, which may include a preheater, configured in a parallel flow arrangement, a second heat exchanger, which may include a vaporizer, configured in a counter flow configuration, and a third heat exchanger, which may include a superheater, configured in a parallel flow arrangement. The exhaust fluid may travel through the heat exchanger system by being channeled first to the first heat exchanger, next to the third heat exchanger, and then to the second heat exchanger. The working fluid may travel through the system by being channeled first to the first heat exchanger, next to the second heat exchanger, and then through the third heat exchanger.

DETAILED DESCRIPTION

Figure 1:
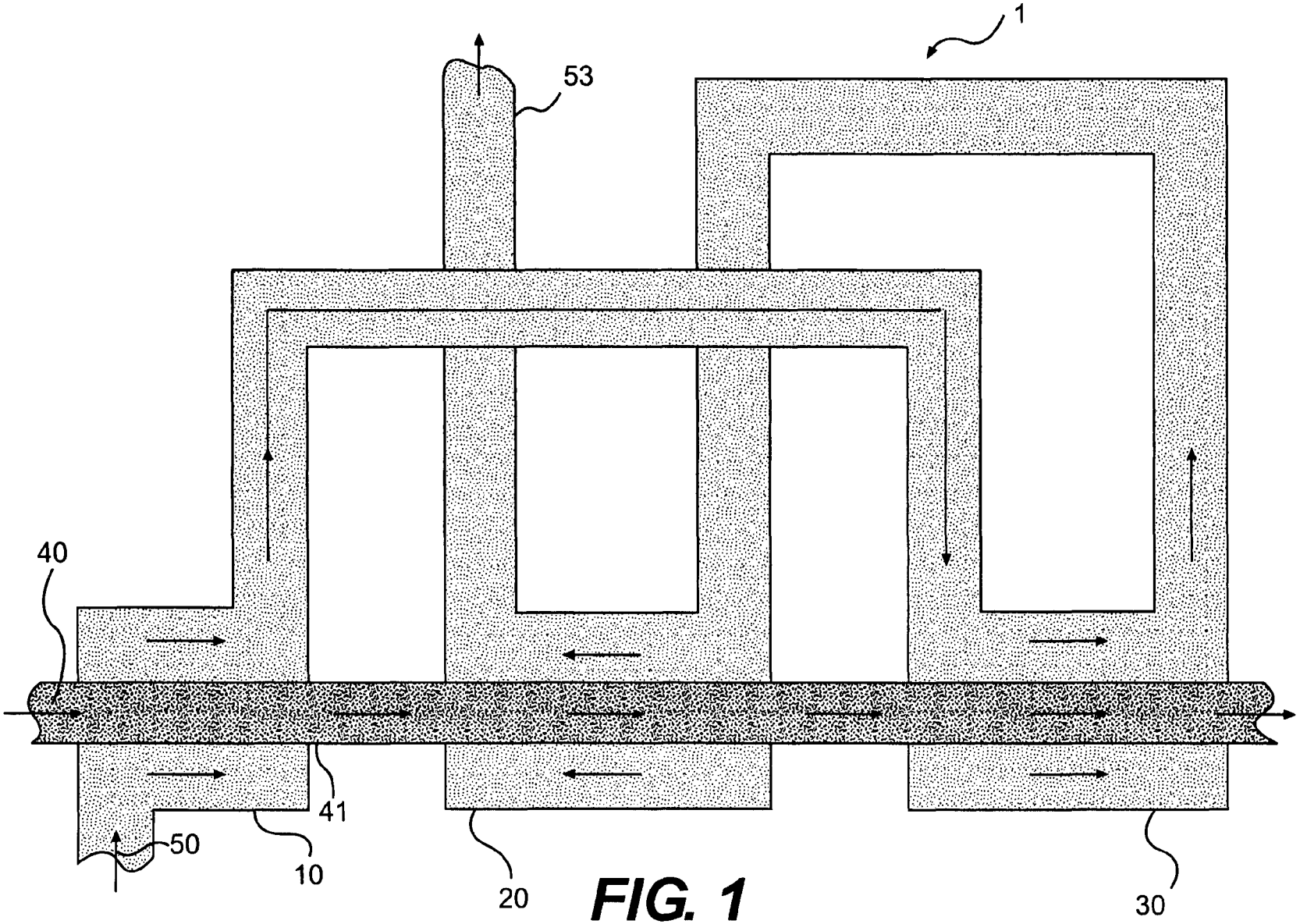
FIG. 1 is a schematic illustration of an exemplary segmented heat exchanger system in accordance with the present disclosure.

Referring now to FIG. 1, there is illustrated an embodiment of a segmented heat exchanger system 1 in accordance with the present disclosure. For discussion purposes only, segmented heat exchanger system 1 is described in connection with an organic Rankine system, which utilizes a chemical (e.g., pentane, butane, freon, propane, and ammonia) as the working fluid. One skilled in the art will recognize, however, that the segmented heat exchanger system 1 of the present disclosure may be used with any system that utilizes a heated working fluid, including water or steam, which results in the production of an exhaust fluid that contains residual heat energy. Additionally, methods of recovering residual heat energy recited herein may be carried out in any order of the recited events which is logically possible, as well as the recited order of events.

In the illustrated embodiment, segmented heat exchanger system 1 may include a plurality of individual heat exchangers, such as, for example, first heat exchanger 10, second heat exchanger 20, and third heat exchanger 30. Although the illustrated example depicts three individual heat exchangers, one skilled in the art will readily recognize that segmented heat exchanger system 1 may include a greater or lesser number of individual heat exchangers, and that individual heat exchangers 10, 20, 30 may be of any suitable configuration and/or type known in the art. For exemplary purposes only, first heat exchanger 10 may include a parallel flow preheater, second heat exchanger 20 may include a counter flow vaporizer, and third heat exchanger 30 may include a parallel flow superheater.

With continuing reference to FIG. 1, residual heat energy in exhaust gases 50 may be used to heat working fluid 40 by first ducting exhaust gases 50 to first heat exchanger 10. Ducting of exhaust gases through segmented heat exchanger system 1 may be achieved by any suitable means known in the art. In addition, working fluid 40 may be piped into first heat exchanger 10. Similarly, piping of working fluid 40 may be achieved by any suitable means known in the art. As discussed previously, first heat exchanger 10 may include a preheater having a parallel flow arrangement. That is to say, both exhaust gases 50 and working fluid 40 may enter first heat exchanger 10 at substantially the same end, travel in parallel through first heat exchanger 10, and exit first heat exchanger 10 at substantially the same end. Since the greatest transfer of heat energy is likely to occur where the largest temperature difference occurs, such an arrangement may improve heat transfer efficiency by allowing the hottest exhaust gases to heat the coolest incoming working fluid.

Next, in order to maximize exhaust heat utilization while managing surface temperatures of the heat exchangers, the working fluid 40 leaving first heat exchanger 10 at exit 41 may be piped directly to second heat exchanger 20, such as, for example, a vaporizer. Exhaust gases 50, however, may bypass the second heat exchanger 20 and be ducted from the first heat exchanger 10 directly to the third heat exchanger 30, which may include, for example, a superheater, to heat working fluid 40 entering the third heat exchanger 30 from the second heat exchanger 20. Both exhaust gases 50 and working fluid 40 may also travel through third heat exchanger 30 in a parallel flow arrangement, as discussed above in connection with first heat exchanger 10.

Exhaust gases 50 may next be ducted from third heat exchanger 30 to the second heat exchanger 20, to heat working fluid 40 entering second heat exchanger 20 from first heat exchanger 10. As shown in FIG. 1, exhaust gases 50 may travel through second heat exchanger 20 in a counter flow arrangement relative to working fluid 40. That is to say, the hottest exhaust gases 50 entering second heat exchanger 20 heats the hottest working fluid 40 just before it leaves the second heat exchanger 20.

While it is contemplated that additional individual heat exchangers may be utilized with the segmented heat exchanger system 1, the illustrated embodiment provides for exhaust gases 50 leaving second heat exchanger 20 via stack 53 to escape segmented heat exchanger system 1 into, for example, the atmosphere. Similarly, working fluid 40 may be piped out of segmented heat exchanger system 1 to, for example, a high pressure turbine (not shown).

INDUSTRIAL APPLICABILITY

The segmented heat exchanger system 1, first, second, and third heat exchangers 10, 20, 30, and the method of recapturing residual heat energy in exhaust gases 50 to heat a working fluid 40 of the present disclosure are generally applicable to any system that uses a heated working fluid and consequently produces a hot exhaust fluid. Such systems may include, but are not limited to, power producing plants, fuel systems, coal burning systems, turbines, and engines.

In addition to addressing working fluid degradation, as mentioned above and will be discussed further below, segmented heat exchanger system 1 may improve overall efficiency of any system utilizing a heated working fluid. Systems that utilize a heated working fluid generally require burning a fuel, such as, for example, coal, to produce the heat necessary to heat the working fluid. Segmented heat exchanger system 1 may provide for the recapture of a portion of any wasted exhaust heat, to aid in the heating of the working fluid, thereby increasing the overall efficiency of the burned fuel and the system. In addition, utilizing residual exhaust heat may result in a reduction of fuel necessary to adequately heat the working fluid, harmful agents released into the atmosphere, and operating costs.

As eluded to above, the segmented heat exchanger system 1 and the method of recapturing residual heat energy in exhaust gases 50 to heat a working fluid 40 of the present disclosure may find particular applicability in relation to systems utilizing an organic Rankine cycle in which exceedingly high surface temperatures of heat exchangers may result in working fluid degradation. By utilizing a segmented heat exchanger arrangement in which individual heat exchangers are designed for specific purposes such as, for example, preheating, vaporizing, and superheating, by operating the first and third heat exchangers 10, 30 in a parallel flow arrangement, by operating the second heat exchanger 20 in a counter flow arrangement, and by channeling the exhaust gases 50 and working fluid 40 as discussed above, the segmented heat exchanger system 1 of the present disclosure may provide for maximum heat transfer while maintaining heat exchanger surface temperatures below the fluid degradation temperature of the working fluid, thereby reducing working fluid breakdown.

It will be apparent to those skilled in the art that various modifications and variations can be made to the segmented heat exchanger system 1 of the present disclosure without departing from the scope of the disclosure. In addition, other embodiments will be apparent to those skilled in the art from the consideration of the specification and practice of the system disclosed herein. It is intended that the specification and examples be considered as exemplary only, with a true scope of the disclosure being indicated by the following claims and their equivalents.

What is claimed is:

1. A segmented heat exchanger system for transferring heat energy from an exhaust fluid to a working fluid, comprising:

a first heat exchanger for receiving incoming working fluid and the exhaust fluid, the working fluid and exhaust fluid traveling through at least a portion of the first heat exchanger in a parallel flow configuration;

a second heat exchanger for receiving working fluid from the first heat exchanger and exhaust fluid from a third heat exchanger, the working fluid and exhaust fluid traveling through at least a portion of the second heat exchanger in a counter flow configuration relative to one another; and the third heat exchanger for receiving working fluid from the second heat exchanger and exhaust fluid from the first heat exchanger, the working fluid and exhaust fluid traveling through at least a portion of the third heat exchanger in a parallel flow configuration, the working fluid flowing in series from the first heat exchanger to the second heat exchanger and then to the third heat exchanger.

2. The segmented heat exchanger system of claim 1, wherein the first heat exchanger includes a preheater.

3. The segmented heat exchanger system of claim 2, wherein the second heat exchanger includes a vaporizer.

4. The segmented heat exchanger system of claim 3, wherein the third heat exchanger includes a superheater.

5. The segmented heat exchanger system of claim 1, wherein the exhaust fluid includes exhaust gases produced by a system utilizing a heated or super-heated working fluid.

6. The segmented heat exchanger system of claim 1, wherein the working fluid includes a chemical.

7. The segmented heat exchanger system of claim 1, wherein the segmented heat exchanger system is used in connection with a Rankine cycle.

8. The segmented heat exchanger system of claim 7, wherein the Rankine cycle is an organic Rankine cycle.

9. The segmented heat exchanger system of claim 1, wherein the working fluid includes a liquid.

10. The segmented heat exchanger system of claim 1, wherein the working fluid includes a vapor.

11. A method of heating a working fluid with heat energy contained in an exhaust fluid, comprising the steps of:

providing a segmented heat exchanger system comprising:

a first heat exchanger configured in a parallel flow arrangement;

a second heat exchanger configured in a counter flow arrangement; and a third heat exchanger configured in a parallel flow arrangement;

channeling the working fluid in series first through the first heat exchanger, next through the second heat exchanger, and then through the third heat exchanger; and channeling the exhaust fluid first through the first heat exchanger, next through the third heat exchanger, and then through the second heat exchanger.

12. The method of claim 11, wherein the first heat exchanger includes a preheater, the second heat exchanger includes a vaporizer, and the third heat exchanger includes a superheater.

13. A segmented heat exchanger system for transferring heat energy from an exhaust fluid to a working fluid, comprising:

a first heat exchanger configured in a parallel flow arrangement, the first heat exchanger including a preheater;

a second heat exchanger configured in a counter flow configuration, the second heat exchanger including a vaporizer; and a third heat exchanger configured in a parallel flow arrangement, the third heat exchanger including a superheater, wherein the exhaust fluid travels through the system by being channeled first to the first heat exchanger, next to the third heat exchanger, and then to the second heat exchanger, the working fluid travels through the system by being channeled first to the first heat exchanger, next to the second heat exchanger, and then through the third heat exchanger, and the second heat exchanger is configured in the counter flow configuration such that a majority of the exhaust fluid in the second heat exchanger flows counter to a majority of the working fluid in the second heat exchanger.

14. The segmented heat exchanger system of claim 1, further comprising a fluid communication line connecting the first heat exchanger to the second heat exchanger such that substantially all the working fluid received by the second heat exchanger flows through the fluid communication line from the first heat exchanger.

15. The segmented heat exchanger system of claim 1, further comprising a fluid communication line connecting the second heat exchanger to the third heat exchanger such that substantially all the working fluid received by the third heat exchanger flows through the fluid communication line from the second heat exchanger.

16. The segmented heat exchanger system of claim 1, wherein the second heat exchanger is configured in the counter flow configuration such that substantially all of the exhaust fluid in the second heat exchanger flows counter to substantially all of the working fluid in the second heat exchanger.

17. The method of claim 11, further comprising:

channeling substantially all the working fluid exiting the first heat exchanger to the second heat exchanger; and channeling substantially all the working fluid exiting the second heat exchanger to the third heat exchanger.

18. The method of claim 11, further comprising directing a majority of the exhaust fluid in the second heat exchanger counter to a majority of the working fluid in the second heat exchanger.

19. The method of claim 11, further comprising:

directing a majority of the exhaust fluid in the first heat exchanger parallel to a majority of the working fluid in the first heat exchanger; and directing a majority of the exhaust fluid in the third heat exchanger parallel to a majority of the working fluid in the third heat exchanger.

20. The segmented heat exchanger system of claim 13, wherein:

the first heat exchanger is configured in the parallel flow arrangement such that a majority of the exhaust fluid in the first heat exchanger flows parallel to a majority of the working fluid in the first heat exchanger, and the third heat exchanger is configured in the parallel flow arrangement such that a majority of the exhaust fluid in the third heat exchanger flows parallel to a majority of the working fluid in the third heat exchanger.

* * * * *